US005606930A

United States Patent [19]

LeBlanc et al.

[11] Patent Number: 5,606,930

[45] Date of Patent: *Mar. 4, 1997

[54] HAND OPERATED TROLLING MOTOR CONTROL STATION

[76] Inventors: Garry R. LeBlanc, P.O. Box 8713, Lumberton, Tex. 77657; Brad J. LeBlanc, Star Rte. 2, Box 183, Silsbee, Tex. 77656

[ * ] Notice: The term of this patent shall not extend beyond the expiration date of Pat. No. 5,507,242.

[21] Appl. No.: 622,200

[22] Filed: Mar. 26, 1996

Related U.S. Application Data

[63] Continuation-in-part of Ser. No. 401,806, Mar. 10, 1995, Pat. No. 5,507,242.

[51] Int. Cl.[6] ..... B63H 25/00

[52] U.S. Cl. ..... 114/144 R; 440/6; 114/144 E

[58] Field of Search ..... 440/6, 62, 7, 53; 114/153, 144 R, 144 E; 74/480 B

[56] References Cited

U.S. PATENT DOCUMENTS

| | | | |
|---|---|---|---|
| 3,386,308 | 1/1966 | Butler . | |
| 3,602,181 | 8/1971 | Harris . | |
| 3,861,348 | 1/1975 | Beierle . | |
| 3,940,674 | 2/1976 | Gill . | |
| 4,604,066 | 8/1986 | Davatz . | |
| 4,614,900 | 9/1986 | Young | 114/144 E |
| 4,698,032 | 10/1987 | Hill . | |
| 4,824,408 | 4/1989 | Aertker et al. | 114/153 |
| 4,962,717 | 10/1990 | Tsumiyama . | |
| 5,052,325 | 10/1991 | Rhines . | |
| 5,507,242 | 4/1996 | LeBlanc et al. | 114/144 R |

FOREIGN PATENT DOCUMENTS

| | | |
|---|---|---|
| 62-289499 | 10/1991 | Japan . |

*Primary Examiner*—Edwin L. Swinehart
*Attorney, Agent, or Firm*—Richard C. Litman

[57] ABSTRACT

A hand operated remote control station for marine trolling motors. The hand operated remote control station enhances or replaces existing remote foot control stations for trolling motors. The remote control station controls the trolling motor by a transmitted signal. The remote hand control station is a totally adjustable, non-corrosive, telescoping steering shaft on which are placed the electric controls to remotely operate a trolling motor, such as power switches and speed control devices.

13 Claims, 2 Drawing Sheets

HAND OPERATED TROLLING MOTOR CONTROL STATION

CROSS-REFERENCE TO RELATED APPLICATION

This application is a continuation-in-part of application Ser. No. 08/401,806 filed Mar. 10, 1995 U.S. Pat. No. 5,507,242.

BACKGROUND OF THE INVENTION

1. Field of the Invention

The present invention relates to trolling motor controllers used to control small electric propulsion units on recreational fishing boats when engaged in fishing activities.

2. Description of the Prior Art

Many small recreational fishing vessels are equipped with electric trolling motors which are used to maneuver the vessel when fishing at a desired location. Such motors have the advantages of running for extended periods of time on little energy and with minor disturbance of the water surrounding the vessel.

It is desirable to be able to comfortably control these trolling motors from the station from which the fisherman engages in fishing activities. The prior art shows control arms extending from the head of the motor and also remote control units which are foot controlled. For instance, U.S. Pat. No. 3,386,308, issued Jan. 3, 1966, to M. H. Butler shows boat controller having a reciprocal handle in a control arm.

U.S. Pat. No. 3,602,181, issued Aug. 31, 1971 to G. H. Harris shows a foot operated remote controller for a trolling motor.

U.S. Pat. No. 3,861,348, issued Jan. 21, 1975 to J. C. Beierle shows a control arm directly attached to a trolling motor.

U.S. Pat. No. 3,940,674, issued Feb. 24, 1976, to G. H. Gill shows hand controller for a submarine to control four motor systems.

U.S. Pat. No. 4,604,066, issued Aug. 5, 1986 to C. R. Davatz shows a mechanical hand control assembly meant to be attached to a specific foot control pedal.

U.S. Pat. No. 4,962,717, issued Oct. 16, 1990, to Y. Tsumiyama shows a control stick including steering and throttle controls for a small boat.

U.S. Pat. No. 4,698,032, issued Oct. 6, 1987 to D. A. Hill shows a telescoping control arm directly attached to a trolling motor.

U.S. Pat. No. 5,052,325, issued Oct. 1, 1991 to M. Rhines shows a chair mounted controller for a trolling motor.

Japanese Patent No. 62-289499, issued Dec. 16, 1987 to T. Hosoya shows a trolling motor with a control handle.

None of the above inventions and patents, taken either singly or in combination, is seen to describe the instant invention as claimed.

SUMMARY OF THE INVENTION

It is desirable when fishing to have continual access to the trolling motor controller at the station from which one fishes. It is important that the controller not interfere with the operator's balance in the boat nor interfere with the fishing apparatus. As discussed above controllers with arms which attach directly to the motor have been developed. However, these type of devices require that the fisherman maintain a close proximity to the motor mount. These devices also require the arm to be horizontally rotated to steer the motor. This rotation can cause the control arm to be in an inaccessible or inconvenient position at times. Also developed to overcome some of these disadvantages are remote control devices which are operated by the operator's foot. These foot controllers also have disadvantages in certain boats and conditions. These controllers require that an operator control the vessel with a foot which precludes maintaining a solid stance in the vessel usually at times when sure footing is most needed, such as when accelerating or turning the vessel.

The present invention is a hand control station which allows the operator to maintain a solid stance in the vessel while controlling a trolling motor. The hand control station includes a telescoping shaft connected at one end to a base through an adjustable cog clamp. At the other end is a hand grip including a speed control knob and a power switch. The shaft is connected to a transmitter for transmitting motor control signals to the trolling motor responsive to movement of the shaft. The vessel may thus be steered by pushing or pulling on the shaft which action produces a control signal transmitted to the trolling motor. This configuration allows the base to be located anywhere on the vessel and allows the handgrip to be conveniently positioned anywhere around the base for continual access. This arrangement allows an operator to have both feet firmly planted on deck and may also help maintain the operator's balance, as the controller is grasped in the hand when used to remotely control the operation of a trolling motor. These characteristics sharply reduce the chance of the operator being thrown overboard.

Accordingly, it is a principal object of the present invention to provide a convenient remote hand control station for electric trolling motors.

It is another object of the invention to provide a remote hand control station that will assist and will not interfere with an operators balance.

It is a further object of the invention to provide a remote hand control station that is totally adjustable such that it may be located at any convenient location around the operator.

It is a still further object of the invention to provide a remote hand control station which is not physically connected with a trolling motor, but transmits control signals to the trolling motor.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
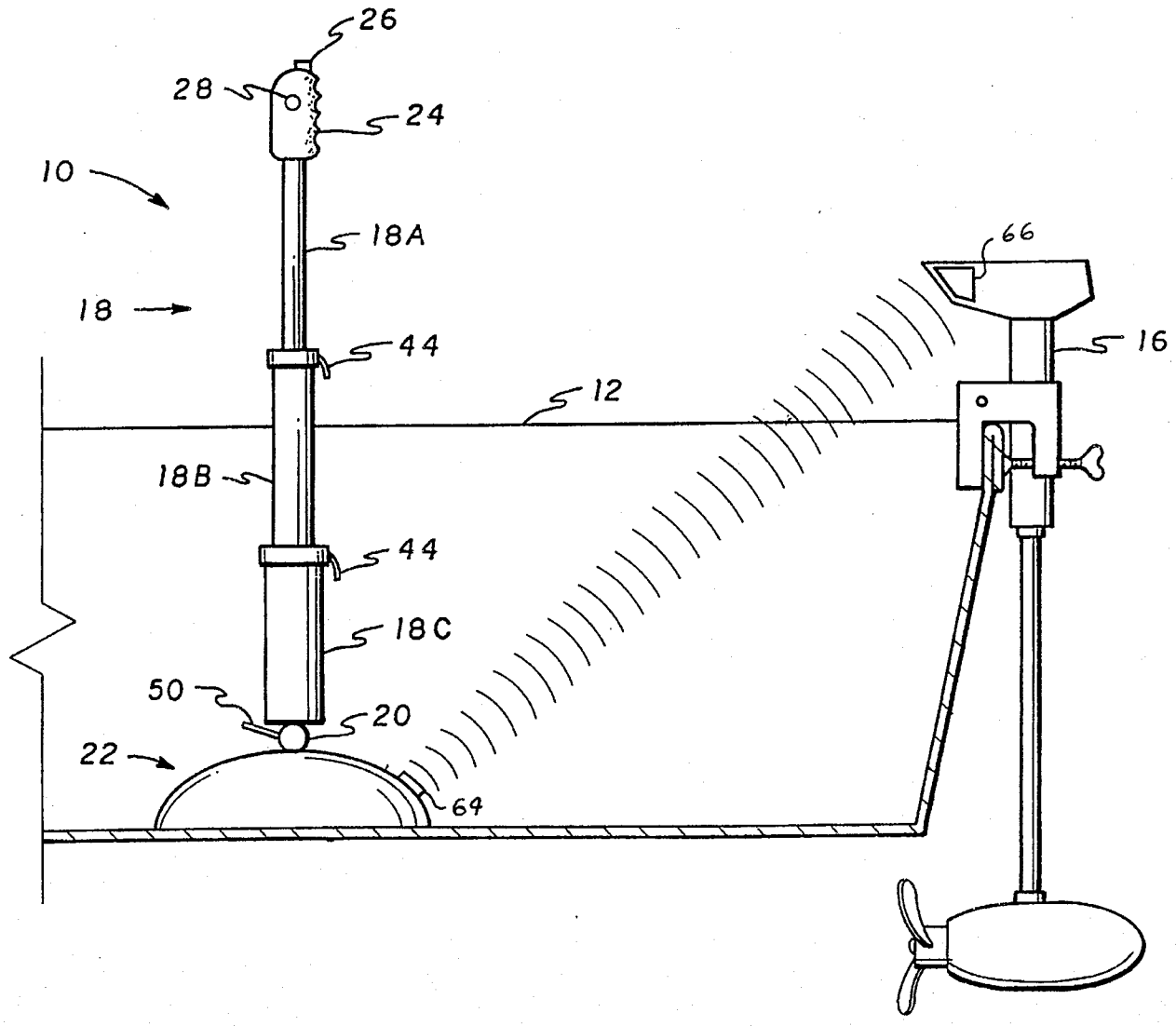
FIG. 1 as an elevational view of the hand control station and a trolling motor in a portion of a boat.
Figure 3:
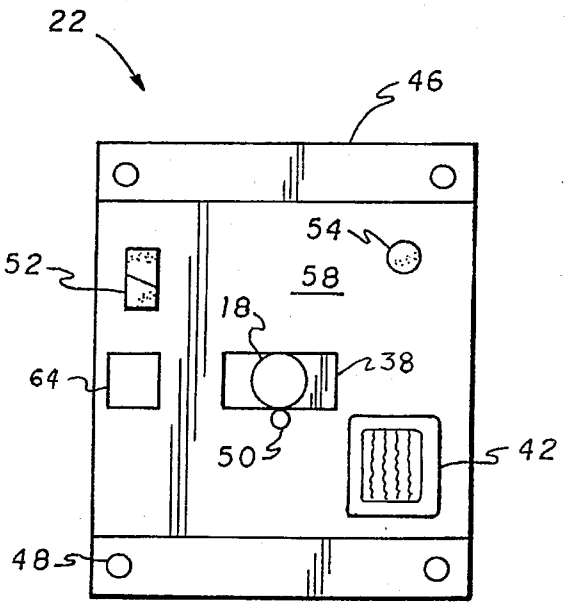
FIG. 3 is top view of the hand control station of the present invention.

The hand control station 10 of the present invention is shown in boat 12 in FIG. 1. Controller 10 comprises telescoping shaft 18 which is connected to water repellent base 22. Base 22, as shown in FIG. 3, includes removable base plate 46 which secures controller 10 to boat 12 through bolt holes 48. At the end of shaft 18 distal from the connection to base 22 is an ergonomic hand grip 24. Included in hand grip 24 is power switch 26 and a rheostat including a speed control knob 28 which protrudes from the hand grip 24. The rheostat controls the speed of motor 16.

Figure 2:
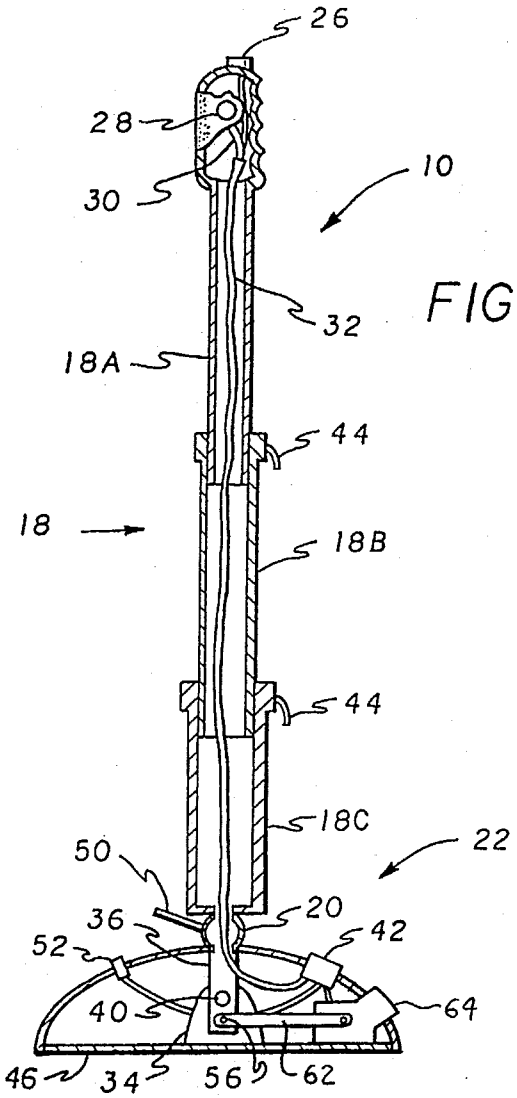
FIG. 2 is a section of the hand control station of the present invention.

As shown in FIG. 2, insulated control wires 30 from power switch 26 and from the rheostat are captured in flexible conduit 32 and run to the wireless transmitter 64 through shaft 18. In the preferred embodiment there are five small wires, two of which connect to power switch 26 and three of which connect to the rheostat. These wires are of such a small size that flexible conduit 32 does not interfere with the operation shaft 18.

Shaft 18 is comprised from a plurality of hollow sections shown as 18*a*, 18*b*, and 18*c* in FIG. 1. Section 18*a* is the smallest section and forms the upper end of shaft 18 and fits into larger section 18*b* which itself fits into a successively larger section. Sections in the preferred embodiment are formed from aluminum.

At the top of each section, except top section 18*a*, are clamp locks 44. Clamp locks 44 are commonly known quick type locks which use levers to selectively tighten the top of a shaft section around a captured smaller section, thus selectively preventing the relative movement of adjacent sections. Clamp locks 44 are formed from non-corrosive material such as plastic.

The lower end of shaft 18 distal from hand grip 24 is formed from connection element 36 and passes through the housing 58 of base unit 22 at seal 38, as shown in FIG. 3. Connection element 36 is attached to the bottom section 18*c* through cog clamp 20. Cog clamp 20 is formed from two serrated plates that when tightened together with handle 50 will hold the upper portion of shaft 18 at any desired angle relative to base 22. Cog clamp 20 also allows shaft 18 to be stowed horizontally. The telescoping action allows the length of shaft 18 to be adjusted. This arrangement provides for the placement of hand grip 24 such that the steering, speed, and power controls of motor 16 will be maintained at the operator's finger tips.

Connection element 36 is connected to base 22 at an upper connection point at pivot pin 40. Connection element 36 is connected to spline 34 contained in base 22 through pivot pin 40. Below the upper connection point is lower connection point 56 connected to linkage 62. Linkage 62 is connected to wireless transmitter 64. Wireless transmitter 64 translates the motion of linkage 62 to steering control signals to be transmitted to electric trolling motor 16. When hand grip 24 is pushed forward shaft 18 transmitter 64 produces a signal which causes motor 16 to turn to the right. In reverse, when hand grip 24 pulled back transmitter 64 produces a signal which causes motor 16 to turn to the left. Included on pivot pin 40 is a friction control mechanism, such as nut fitted on a threaded portion of pivot pin 40. The friction control mechanism controls the force required to rotate shaft 18 around pivot pin 40. Thus when the friction control mechanism is tightened the force required to move hand grip 24 when steering boat 12 is increased. Also included in base are electric controls for motor 16, including foot controlled rheostat 42 for controlling the speed of motor 16, power switch and voltage selector switch 52 for selecting between 12 and 24 volt operation of motor 16.

Wireless transmitter 64 transmits control signals to wireless receiver 66 connected with the trolling motor control system. Trolling motor 16 includes a steering servomotor which is also controlled in response to signals received by wireless receiver 66. The steering servomotor turns motor 16 to steer boat Technologies which may be employed by transmitter 64 to create the control signals include infrared, radio frequencies, microwave, laser beams, and sonic waves.

It is to be understood that the present invention is not limited to the sole embodiment described above, but encompasses any and all embodiments within the scope of the following claims.

We claim:

1. A remote hand control station for an electric trolling motor comprising:

a shaft including a first end and a second end;

an electric speed control device located on said shaft;

conversion means for translating angular motion of said shaft to a steering control signal;

transmission means for transmitting said steering control signal to a steering system of the trolling motor; and a base including a foot controlled electric speed control device, said base containing said conversion and said transmission means.

2. The remote hand control station according to claim 1, wherein said electric speed control device includes a rheostat electrically connected to an electric control system of the trolling motor.

3. The remote hand control station according to claim 1, wherein said shaft is comprised of a plurality of telescoping sections whereby the height of said shaft is adjustable.

4. The remote hand control station according to claim 1, further comprising:

an adjustment means for selectively altering and maintaining an angle between said shaft and said base.

5. The remote hand control station according to claim 4, wherein said shaft is comprised of a plurality of telescoping sections whereby said second end of said shaft is adjustable to any convenient position for a user of the control station.

6. The remote hand control station according to claim 5, wherein said adjustment means includes a cog clamp.

7. The remote hand control station according to claim 6, wherein a plurality of said telescoping sections further comprise clamp locks which selectively maintain the relative positions of said telescoping sections thereby maintaining the height of said shaft.

8. The remote hand control station according to claim 7, further comprising a power switch contained in said second end of said shaft and wherein said second end of said shaft also contains said electric speed control device.

9. The remote hand control station according to claim 8, further comprising a plurality of control wires connecting said speed control device and said power switch with an electric control system of the trolling motor, and wherein said control wires run from said speed control device and said power switch to said base through said telescopic sections of said shaft.

10. The remote hand control station according to claim 9, further comprising a flexible conduit housing said control wires.

11. The remote hand control station according to claim 10, wherein said conversion means includes means for selectively altering the force required to produce angular motion of said shaft.

12. The remote hand control station according to claim 11, wherein said base includes a removable base plate.

13. An electric marine trolling propulsion assembly comprising:

an electric trolling motor including a wireless receiver for receiving control signals;

a hand remote control station including, a shaft including an upper end and a lower end wherein said shaft is comprised from, a plurality of hollow telescoping sections including at least a smallest section which forms said upper end of said shaft and a largest section, a connection element which forms said lower end of said shaft including an upper connection point and a lower connection point, and a cog clamp which connects said largest section with said connection element, an ergonomic hand grip attached to said upper end of said shaft, a first power switch on said hand grip, a first rheostat contained in said hand grip including a control knob which extends from said hand grip, a base comprising, a base plate including means for attachment to a boat, a housing removable attached to said base plate, said housing including an opening through which said shaft passes, a seal positioned in the opening, and a spline positioned below the opening, a second power switch on said base, a foot controlled rheostat on said base, and a pivot pin including a friction control mechanism which attaches said spline to said upper connection point of said connection element;

a wireless transmitter within said base, said wireless transmitter for transmitting control signals to said electric trolling motor;

a linkage connecting said wireless transmitter with said lower connection point of said shaft; and a plurality of insulated electric control wires running through said shaft to said wireless transmitter.

* * * * *